United States Patent [19]

Sweeny

[11] Patent Number: 4,932,702

[45] Date of Patent: Jun. 12, 1990

[54] AUXILIARY HANDLE

[75] Inventor: Henry D. Sweeny, Kitchener, Canada

[73] Assignee: Swenco Limited, Waterloo, Canada

[21] Appl. No.: 368,796

[22] Filed: Jun. 20, 1989

[30] Foreign Application Priority Data

May 4, 1989 [CA] Canada ..... 598728

[51] Int. Cl.[5] ..... A45C 13/26; B65D 33/06

[52] U.S. Cl. ..... 294/171; 383/13

[58] Field of Search ..... 294/137, 153, 154, 156, 294/170, 171; 16/110 R, 114 R,B, DIG. 12; 220/94 R, 96; 229/52 A; 383/6, 13, 25, 29

[56] References Cited

U.S. PATENT DOCUMENTS

| | | | |
|---|---|---|---|
| 1,576,546 | 3/1926 | Ransom | 294/171 |
| 2,122,025 | 6/1938 | Crary | 294/171 |
| 2,684,797 | 7/1954 | Schulte | 16/114 B |
| 2,846,714 | 8/1958 | Charlick | 294/171 X |
| 3,912,140 | 10/1975 | Franges | 16/114 B X |
| 4,590,640 | 5/1986 | Enersen | 294/171 X |

FOREIGN PATENT DOCUMENTS

| | | | |
|---|---|---|---|
| 2840676 | 4/1980 | Fed. Rep. of Germany | 294/171 |
| 873710 | 7/1961 | United Kingdom | 294/171 |
| 911948 | 12/1962 | United Kingdom | 294/171 |
| 2147200 | 5/1985 | United Kingdom | 294/171 |
| 2202135 | 9/1988 | United Kingdom | 294/171 |

*Primary Examiner*—Johnny D. Cherry

*Attorney, Agent, or Firm*—Jones, Tullar & Cooper

[57] ABSTRACT

An auxiliary handle for use with containers such as bags, pails or cans having handle portions included therewith has a longitudinally arcuate base portion and a pair of side walls converging upwardly from opposite sides of the base portion. A pair of ribs extend from the inner surface of the base portion along the inner surface of each side wall towards the outer edge thereof with the ribs on one wall being opposite the ribs of the other wall so as to define a narrow gap at their point of closest approach. The outer wall or bottom surface of the base portion has transverse finger-receiving recesses therein. The auxiliary handle fits over the handle portion of the container and helps distribute the weight of the container more evenly to ease the load on the person carrying the container. The side walls of the auxiliary handle can be used for advertising purposes.

4 Claims, 1 Drawing Sheet

AUXILIARY HANDLE

The present invention relates to an auxiliary handle with containers such as cans, pails or bags.

BACKGROUND OF THE INVENTION

Flexible plastic bags are used extensively to carry goods of many varieties. They are found in grocery stores where recently-purchased groceries are packed in wicketed plastic handle bags for transport to the consumer's residence. They are also used as original packages for granular material such as pet food, fertilizers and salt. In the latter instances the bag may contain material weighing 20 kilograms or more. The material from which such bags are made is very strong and such bags usually include a punched-out opening at the top through which the purchaser can insert his hand so that he can carry the bag suspended at the end of his arm. Anyone who has carried a heavy bag of fertilizer, salt or groceries in this manner knows that it does not take very long for the bag handle to cut into the hand to, at the very least, make the carrying of the bag an uncomfortable chore. That is because the bag material is very thin and the load is concentrated along a very narrow line across the palm or fingers of the person carrying the bag.

Other heavy articles are often carried by purchasers or users via handles already provided on the articles. Paint cans, for example, have a thin wire-type bail or handle and the carrying thereof for large distances can be very uncomfortable. Similarly, other products of a bulk or heavy nature (e.g. drywall compound), come in large plastic pails provided with a wire-type bail or possibly a narrow flexible plastic handle. These products also are uncomfortable to carry over a large distance.

SUMMARY OF THE INVENTION

The present invention overcomes the problems encountered above by providing an auxiliary handle into which the handle of a bag or other container can be inserted and which more evenly distributes the container's load in the carrier's hand. The auxiliary handle of this invention includes finger recesses into which the carrier's fingers naturally fall and there is a smooth angled side wall against which the carrier's palm can rest. That side wall can also carry suitable indicia of an advertising or product identification nature if desired. The side walls of the auxiliary handle angle inward]y and are provided with vertically extending internal ribs which serve to retain the auxiliary handle on the container's handle or handles in the event that the container is temporarily released from the carrier's hand, as for example if the carrier sets the container on the ground while fumbling for his car keys.

The broad base of the auxiliary handle makes it easy to carry more than one container with the same handle. This can be especially important with grocery bags since the purchaser often is faced with carrying a large number of bags away from a grocery store to his car or home and will welcome anything that makes his task easier.

The auxiliary handle of this invention can be used over and over again as it is made from a strong plastics material. It can be molded in any color and could be a retail product or a promotional product. It can be used with plastic handled bags; it could also be used with paper shopping bags that have rope or cord-type handles; or it can be used with containers such as cans or pails having a bail-type handle. There is sufficient flexibility in the side walls of the auxiliary handle to permit the passage between the ribs of handles that are thicker than the normal minimum spacing between the ribs.

It will be appreciated that there are many advantages to the auxiliary handle of this invention. The invention may be broadly characterized as an auxiliary handle for use with a container having its own handle portion, comprising: narrow base means having a longitudinally generally concave outer surface and a generally parallel longitudinally arcuate inner surface; a pair of planar side walls means converging away from the base means with the base means inner surface being located between the wall means; and means within the wall means for retaining a container handle portion within the auxiliary handle; whereby the auxiliary handle can be engaged with a container handle portion by fitting such container handle portion between the wall means and bringing such container handle portion into contact with the inner surface, a person then being able to better support the container and a load therein by gripping the auxiliary handle rather than the container handle portion itself.

DESCRIPTION OF THE PREFERRED EMBODIMENT

Figure 1:
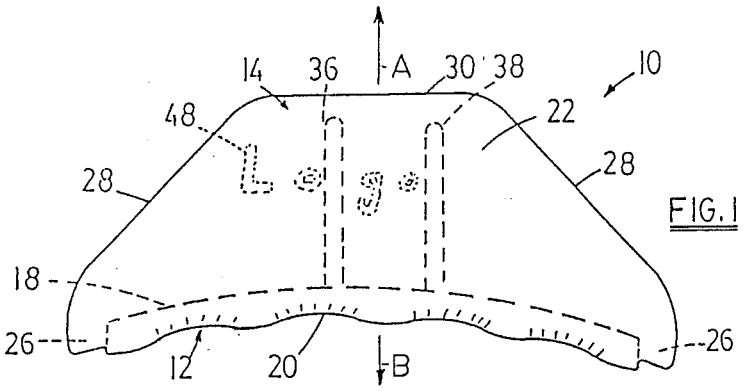
FIG. 1 shows a side view of the auxiliary handle of this invention.
Figure 3:
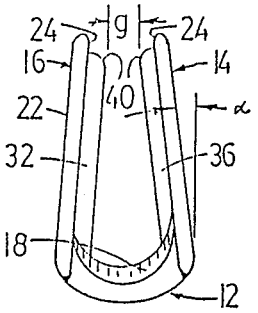
FIG. 3 shows an end view of the handle.

The auxiliary handle of this invention is illustrated in the drawings under reference number 10. The handle includes a longitudinally arcuate base portion 12 and a pair of upstanding side walls 14, 16. As seen in FIGS. 1 and 3, the base portion 12 is relatively thick and includes an inner surface 18 which is both longitudinally curved (see FIG. 1) and transversely curved (see FIG. 3). The bottom surface of the base portion 12 includes a plurality of longitudinally adjacent finger-receiving recesses 20 each of which is both longitudinally arcuate (concave) and transversely curved at the side edges thereof for the comfort of the user. Four such finger-receiving recesses are provided.

Figure 2:
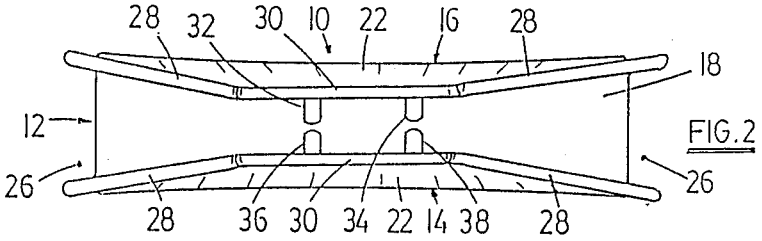
FIG. 2 shows a plan view of the handle.

The side walls 14, 16 extend upwardly from each side of the base portion, the outer surface 22 of each wall merging smoothly with finger-receiving recesses 20 and the inner surface 24 of each wall merging smoothly with the inner surface 18 of the base portion 12. As seen in FIGS. 1 and 2 each side wall 14, 16 extends beyond the end of the base portion at 26 and includes upwardly and inwardly sloping edges 28 and a top edge 30.

Extending downwardly within the auxiliary handle 10 are four narrow ribs 32, 34, 36, 38. The ribs have the same thickness as the side walls 14, 16. They start a short distance below the top edge 30 of each side wall and extend downwardly to the inner surface 18.

As seen in FIG. 3 the side walls 14, 16 converge upwardly from the base portion 12 such that there is a narrow gap "g' between the ribs 32, 36 and 34, 38 on the order of 2 mm at the point of closest approach. The angle $\alpha$, representing the angle of convergence of the side walls, is desirably in the order of 10°.

The convergence of the side walls 14, 16 is not, as would be expected, achieved in the molding process per se. Clearly, it would be difficult to create a suitable mold so that the resulting product would have the desired shape but could still be removed from the mold without damaging the product. In fact the product of this invention is molded with side walls 14, 16 parallel to each other, thereby allowing the mold halves to move smoothly away from each other along the arrows A, B in FIG. 1. By maintaining the precise geometry of the part, as described herein, by selecting the correct material, and by controlling the mold parameters of time, temperature of extrudate, and cooling, the side walls will shrink consistently towards each other to the position shown in FIG. 3. The degree of convergence will depend on the relative amounts of material in the side walls 14, 16, the ribs 32, 34, 36 and 38, and the base portion 12.

As previously indicated, there is a small amount of lateral flexibility associated with the side walls 14, 16. Although the gap "g" is quite small, the flexibility associated with the side walls permits the walls to be separated slightly, thereby increasing the gap "g" so as to permit bag handles of a thickness greater than the gap "g" to pass between the ribs 32, 36 and 34, 38. This is very useful when one auxiliary handle is used with a number of bags, when a bag having a rope or cord-type handle is to be carried, or even when the auxiliary handle is used to carry a container, such as a paint can, having a metal or plastic bail or handle. In the latter instances the rounded upper corner of each rib, as at 40, facilitates the entry of a handle or bail between the ribs, effectively camming the ribs and side walls apart until the bail or handle has passed into the interior of the auxiliary handle.

Figure 5:
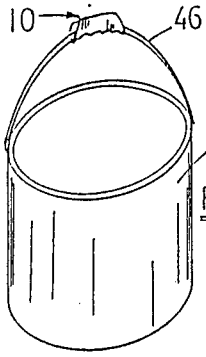
FIG. 5 shows the handle in use with a paint can.
Figure 4:
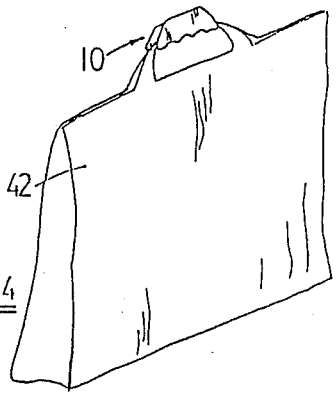
FIG. 4 shows the handle in use with a loaded bag.

FIGS. 4 and 5 show the auxiliary handle 10 in position on two types of container, a grocery bag 42 in FIG. 4 and a paint can 44 in FIG. 5. It is readily seen that in each case the auxiliary handle provides a relatively wide surface having comfortable finger-receiving recesses which can be engaged by a person's hand and fingers to ease the burden of carrying a heavy load in the container. Also, when the load is carried with the fingers engaging the recesses 20, one of the side walls 14, 16 will be against the palm of the person's hand and this provides additional support by ensuring that the hand is in the optimum orientation for carrying and by preventing any unwanted rotation or twisting of the auxiliary handle relative to the container's handle. This latter effect is most desirable with wire-like bails such as the bail 46 on paint can 44.

Finally as indicated previously, the auxiliary handle 10 of this invention is ideally suited for advertising purposes since the relatively large expanse of the outer surface 22 of each side wall 14, 16 may carry a store's logo (48 in FIG. 1) molded into the surface 22 during production or may carry a label hot stamped or transfer printed thereon after production with such label carrying whatever information is deemed appropriate. Also, the auxiliary handle can be molded in any color such as a particular store's or producer's distinctive colors so as to readily associate the auxiliary handle with that store or producer. Since the auxiliary handle of this invention is relatively inexpensive to manufacture, it could be given away as part of a promotion or it could be sold for a small profit adjacent check-out counters in retail stores.

The auxiliary handle of this invention provides an economical effective aid for shoppers or other individuals who often carry heavy loads in bags, pails or cans. It is comfortable and easy to use and meets a definite need in the marketplace. While a preferred form of the invention has been disclosed herein it is understood that a skilled practitioner could effect changes to the product without departing from the spirit of the invention and accordingly the protection to be afforded the invention is to be determined from the scope of the claims appended hereto.

The embodiments of the invention in which an exclusive property or privilege is claimed are defined as follows:

1. An auxiliary handle for use with a container having its own handle portion comprising:

narrow base means having a longitudinally generally downwardly concave outer surface, a longitudinally generally arcuate inner surface, parallel to said outer surface, and a plurality of longitudinally adjacent and concave transversely extending finger-receiving recesses in said outer surface;

a pair of planar side wall means converging upwardly away from said base means and having upper free edges, with said base means inner surface being located between said wall means; and a pair of parallel narrow rib members on an inner surface of each of said wall means, the rib members of one wall means being opposite the rib members of the other wall means and all rib members extending from said base means inner surface to adjacent a free edge of the respective wall means so as to establish a narrow gap between opposite ribs at their point of closest approach, whereby said auxiliary handle can be engaged with a container handle portion by fitting such handle portion between said wall means through said gap and bringing such container handle portion into contact with said inner surface, a person then being able to better support the container and a load therein by gripping the auxiliary handle rather than the container handle portion itself.

2. The auxiliary handle of claim 1 wherein each of said ribs is rounded towards the adjacent free edge of the respective wall means.

3. The auxiliary handle of claim 1 wherein said base means inner surface is transversely concave along the length thereof.

4. The auxiliary handle of claim 1 wherein said wall means at each end thereof extend longitudinally past the adjacent end of the base means.

* * * * *